US005409224A

United States Patent [19]

Schiess

[11] Patent Number: 5,409,224

[45] Date of Patent: Apr. 25, 1995

[54] RECREATIONAL AND EDUCATIONAL GAME APPARATUS

[76] Inventor: Emilie M. Schiess, 330 Nottingham Rd., Syracuse, N.Y. 13210-3425

[21] Appl. No.: 168,190

[22] Filed: Dec. 17, 1993

[51] Int. Cl.[6] ..... A63F 7/00

[52] U.S. Cl. ..... 273/19 R; 273/127 R; 273/129 T

[58] Field of Search ..... 273/118, 119, 121, 127 R, 273/129 R, 5, 7

[56] References Cited

U.S. PATENT DOCUMENTS

| | | | |
|---|---|---|---|
| 138,038 | 4/1873 | Morley . | |
| 674,848 | 5/1901 | Stevens . | |
| 681,570 | 8/1901 | McRuer . | |
| 2,589,839 | 3/1952 | McFerran | 273/121 R |
| 3,033,569 | 5/1962 | Hunt . | |
| 3,224,775 | 12/1965 | Ritz | 273/121 R |
| 3,698,714 | 10/1972 | Breslow . | |
| 3,899,170 | 8/1975 | Parks et al. . | |
| 3,997,163 | 12/1976 | Cooper et al. | 273/119 A X |
| 4,460,175 | 7/1984 | Krynski | 273/121 A X |
| 4,513,967 | 4/1985 | Halford et al. | 273/119 R X |
| 4,548,408 | 10/1985 | Clark | 273/121 A |
| 5,131,654 | 7/1992 | Gottlieb et al. | 273/121 A |
| 5,193,807 | 3/1993 | Schilling et al. | 273/121 R |

*Primary Examiner*—Raleig W. Chiu

*Attorney, Agent, or Firm*—Robert A. Shack; David L. Baker

[57] ABSTRACT

A game apparatus, the game apparatus including a housing, the housing enclosing a playing chamber therewithin, at least one pair of substantially opposing impeller devices sharing a common longitudinal axis, each impeller being capable of impelling a projectile into the playing chamber. Furthermore, each impeller device including a longitudinal bore provided in the housing, a plunger member positioned within the bore and extending outside of the housing, a spring mechanism for biasing the plunger member, and an entry aperture into the bore for the loading of the projectile thereinto, the housing including a panel forming at least a portion of the periphery of the playing chamber, the panel being removable from the housing to thereby permit access to the interior of the playing chamber, the removable panel being substantially transparent, and a plurality of targets for arrangement within the playing chamber, each of the plurality of targets including a three dimensional object having a substantially planar base.

5 Claims, 5 Drawing Sheets

RECREATIONAL AND EDUCATIONAL GAME APPARATUS

BACKGROUND

1. Field of the Invention

The present invention relates to the field of games of luck and skill, more particularly games that require the utilization of the physical coordination skills of the players, and most particularly games that appeal to children and, simultaneously, have an educational aspect to them.

2. Description of the Related Art

U.S. Pat. No. 3,899,170 relates to a game apparatus having an elongated alley with pivoting shooters for projecting marbles removably positioned at each end thereof. A pair of spinner mechanisms are threadingly mounted on a threaded rod between the shooters. Each player aims for the corresponding spinner in an attempt to spin it laterally along the threaded rod to the right where it contacts a buzzer signaling a won game. The spinners and one of the shooters can be removed and miniature bowling pins set up at one end of the elongated alley for bowling game play.

U.S. Pat. No. 3,698,714 relates to a missile launching game having a game board, a weighted target member resting on the game board, and missile members connected to the game board by elastic strands for launching the missiles towards the target by stretching the strands and releasing the missiles.

U.S. Pat. No. 3,033,569 relates to a game apparatus that includes a plurality of balls disposed on a playing surface provided with a number of pockets, a plurality of uprights arranged (e.g., in a circle) about the periphery of the playing surface, elastic strips stretched between the uprights, and a projecting member for hooking onto the elastic strips, pulling outward and then releasing to strike and propel the balls across the playing surface.

U.S. Pat. No. 681,570 relates to a game apparatus that includes a rectangular table with marble propelling devices positioned at the four corners thereof and a central turret with six tunnels leading thereinto. Six toy soldiers on the turret correspond to the six tunnels, and when marbles are propelled into the six tunnels by the players, the six toy soldiers are revealed. When all six toy soldiers have been revealed, four other toy soldiers are elevated thereabove indicating the overthrow of the six previously revealed toy soldiers by the four players.

U.S. Pat. No. 674,848 relates to a game that includes two half box sections that are hinged together and that fold to form a box structure. When opened, the two half box sections form an upwardly open playing field, at two opposite diagonal corners of which are positioned two spring actuated ball propelling devices. Toy soldiers are placed on the playing field at areas indicated on the playing field and are alternately fired upon by the opposing players.

U.S. Pat. No. 138,038 relates to a game that includes a mimic battlefield on which there are positioned a number of toy soldiers fastened thereto by hinges. A gun is positioned at each end of the battlefield for the two players, each gun having a spring for projecting balls to strike and collapse the toy soldiers.

SUMMARY OF THE INVENTION

A number of game apparatuses have been proposed that utilize small spheroid projectiles (e.g., marbles) which are propelled by a spring powered device. Such games are exciting and interesting to very young children. However, many games along this line that are known to date have employed a war motif, e.g., the mock killing of toy soldiers, etc. Parents are increasingly avoiding such games, and are instead more interested in games that have educational characteristics.

Moreover, many of the known projectile games can have dangerous aspects for young children, in that the projectiles are not confined to the playing surface of the game board, but can fly off of the playing surface and cause either property or personal damage.

Accordingly, one object of the present invention is the provision of a game apparatus that is both interesting and recreational for young children, and that also incorporates educational aspects in the play of the game.

Another object of the invention is the provision of such a game apparatus that does not have any violent aspects.

A further object of the invention is the provision of such a game apparatus wherein the danger of projectiles causing damage is significantly reduced.

A still further object of the invention is the provision of such a game apparatus that is simple in operation and construction and, therefore, inexpensive to manufacture.

In one aspect, the invention generally features a game apparatus, the game apparatus including: a housing, the housing enclosing a playing chamber therewithin; at least one pair of substantially opposing impeller devices sharing a common longitudinal axis, said each impeller device capable of impelling a projectile into said playing chamber. Furthermore, each of the substantially opposing impeller devices includes a longitudinal bore provided in the housing; a plunger member positioned within the bore and extending outside of the housing; a spring mechanism for biasing the plunger member; and an entry aperture into the bore for the loading of the projectile thereinto; the housing including a panel forming at least a portion of the periphery of the playing chamber; the panel being removable from the housing to thereby permit access to the interior of the playing chamber; and a plurality of targets for arrangement within the playing chamber.

Preferably, the removable panel is substantially transparent.

In another aspect, the invention generally features a game apparatus, the game apparatus including: a housing, the housing enclosing a playing chamber therewithin; at least one pair of substantially opposing impeller devices sharing a common longitudinal axis, said each impeller device capable of impelling a projectile into said playing chamber. Furthermore, each of the substantially opposing impeller devices includes a longitudinal bore provided in the housing; a plunger member positioned within the bore and extending outside of the housing; a spring mechanism for biasing the plunger member; and an entry aperture into the bore for the loading of the projectile thereinto; the housing including a panel forming at least a portion of the periphery of the playing chamber; the panel being removable from the housing to thereby permit access to the interior of the playing chamber; the removable panel being substantially transparent; and a plurality of targets for arrangement within the playing chamber; each of the plurality of targets including a three dimensional object having a substantially planar base.

Preferably, the three dimensional object includes a rectilinear block member; the rectilinear block members have alphanumeric indicia thereon; the alphanumeric indicia includes sequential numbers printed on the rectilinear block members; the alphanumeric indicia includes sequential letters printed on the rectilinear block members; the rectilinear block members have representations of animals printed thereon; the housing is substantially parallelepiped-shaped, and the removable panel is disposed on an upper surface of the parallelepiped-shaped housing; the parallelepiped-shaped housing has a profile that is substantially square in plan view; and the playing chamber includes a depressed cavity disposed within the periphery of the parallelepiped-shaped housing.

In yet another aspect, the invention generally features a game apparatus, the game apparatus including: a housing, the housing enclosing a playing chamber therewithin; the housing being substantially parallelepiped-shaped; the parallelepiped-shaped housing having a profile that is substantially square in plan view; the playing chamber including a depressed cavity disposed within the periphery of the parallelepiped-shaped housing; at least one pair of substantially opposing impeller devices sharing a common longitudinal axis, said each impeller device capable of impelling a projectile into said playing chamber. Furthermore, each of the substantially opposing impeller devices includes a longitudinal bore provided in the housing; a plunger member positioned within the bore and extending outside of the housing; a spring mechanism for biasing the plunger member; and an entry aperture into the bore for the loading of the projectile thereinto; the housing including a panel forming at least a portion of the periphery of the playing chamber; the panel being removable from the housing to thereby permit access to the interior of the playing chamber; the removable panel being substantially transparent; the removable panel being disposed on an upper surface of the parallelepiped-shaped housing; the removable panel being disposed over and covering substantially all of the depressed cavity; and a plurality of targets for arrangement within the playing chamber; each of the plurality of targets including a rectilinear block member having a substantially planar base.

Preferably, the rectilinear block members have alphanumeric indicia thereon; the alphanumeric indicia includes sequential numbers printed on the rectilinear block members; the alphanumeric indicia includes sequential letters printed on the rectilinear block members; the rectilinear block members have representations of animals printed thereon; the parallelepiped-shaped housing is provided with a depressed ledge structure surrounding the depressed cavity, the removable panel resting on the depressed ledge structure; the parallelepiped-shaped housing is provided with a plurality of depressions surrounding the removable panel for providing a place for an individual to lift the removable panel from the parallelepiped-shaped housing; the game apparatus additionally includes a substantially planar weight disposed in a bottom surface of the housing; and the entry aperture is disposed in an upper surface of the housing.

The invention will now be described by way of a particularly preferred embodiment, reference being made to the accompanying drawings, wherein:

DESCRIPTION OF THE PREFERRED EMBODIMENT

Figure 1:
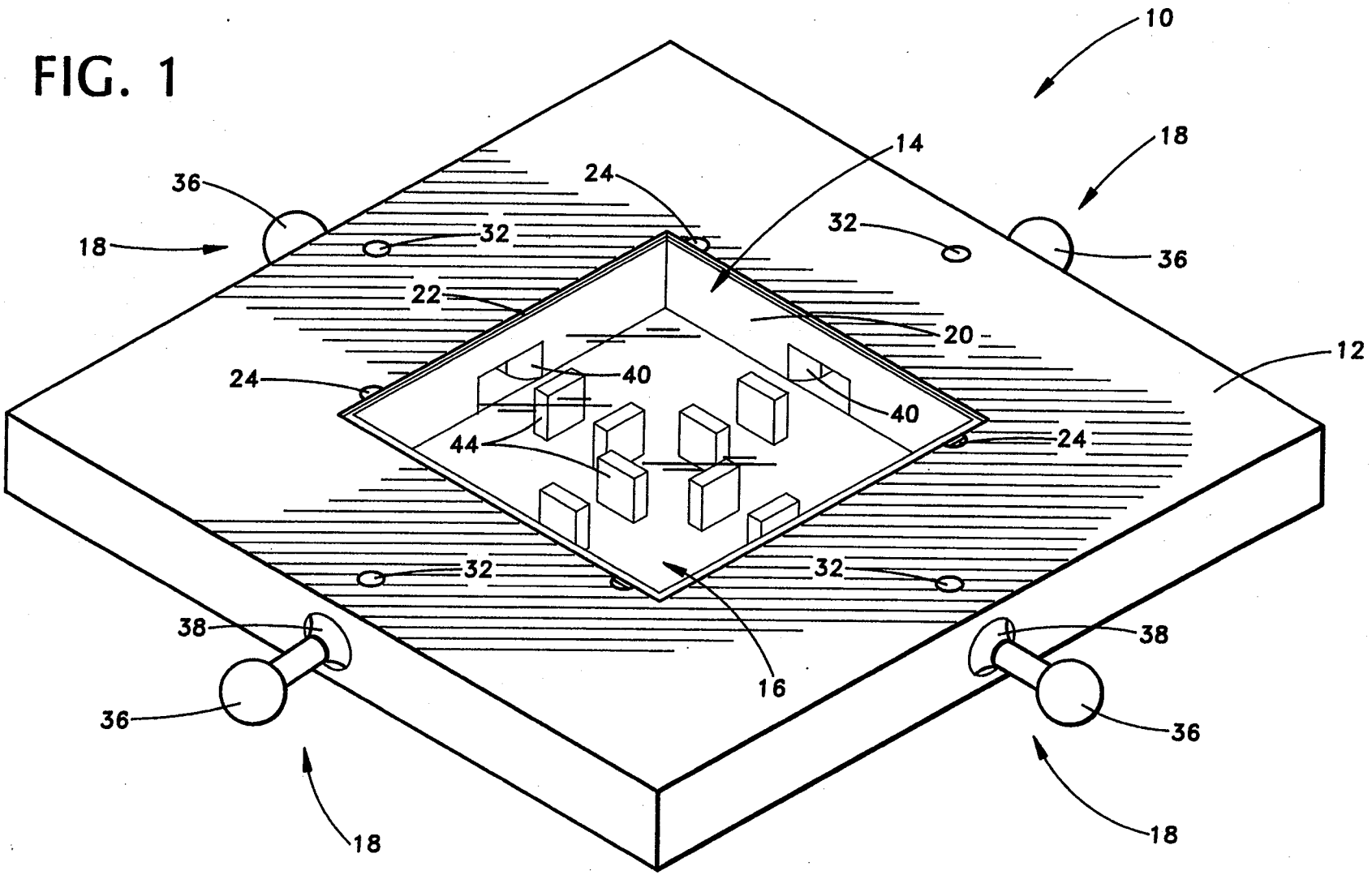
FIG. 1 is a perspective view of a game apparatus constructed according to the present invention.

Referring initially now to FIG. 1, a recreational and educational game apparatus 10 constructed according to the present invention generally includes a housing 12, the housing 12 preferably being parallelepiped-shaped, and the housing 12 even more preferably having a profile that is substantially square when viewed in plan, a playing chamber 14 disposed within the housing 12, the playing chamber 14 preferably being in the form of a depressed cavity 16 formed within the interior of the periphery of the housing 12, at least one, and preferably four, impeller devices 18 positioned about the periphery of the housing 12 for impelling projectiles into the playing chamber 14, and a panel 20 that forms a portion of the periphery of the playing chamber 14. The preferably four impeller devices 18 are situated so as to form two substantially opposing pairs of impeller devices.

The panel 20 is substantially transparent, substantially covers the entirety of the playing chamber 14, and is removable from the housing 12 to permit access by the players of the game to the playing chamber 14. To this end, the depressed cavity 16 is provided with a ledge structure 22 about its upper periphery upon which the panel 20 rests, and the housing 12 is provided with a number of depressions 24 that allow the players to insert a finger, grasp, and lift the removable panel 20 from the housing 12. Preferably, four such depressions 24 are provided, one adjacent each of the four sides of the preferably square removable panel 20.

Figure 2:
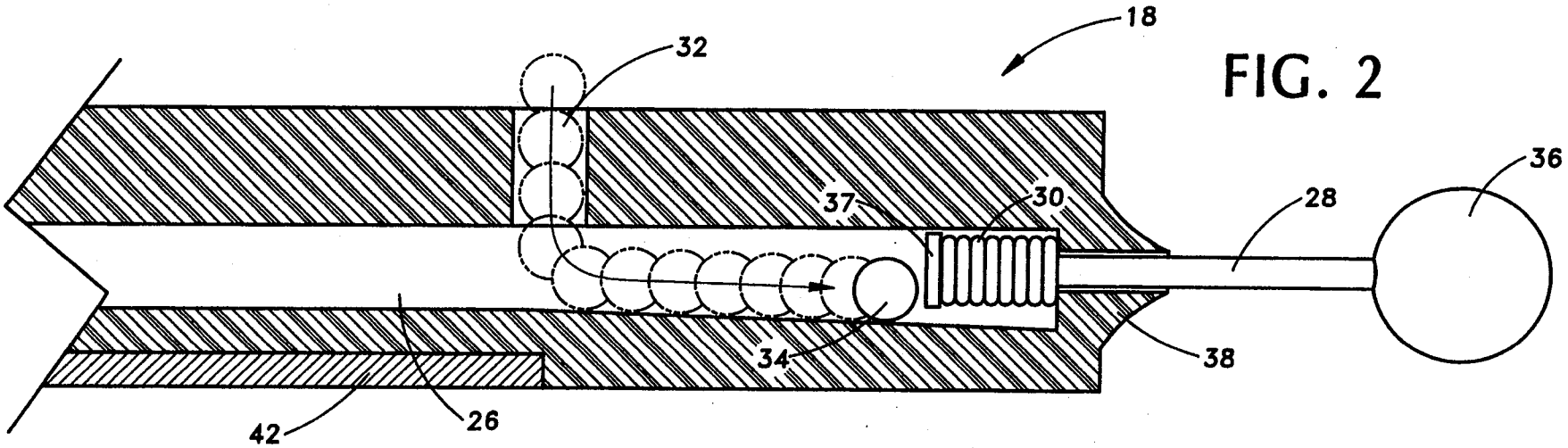
FIG. 2 is a cross sectional elevational view of an impelling device used in the inventive game apparatus, the impelling device being shown in a flexed configuration prior to the ejection of a projectile therefrom.
Figure 3:
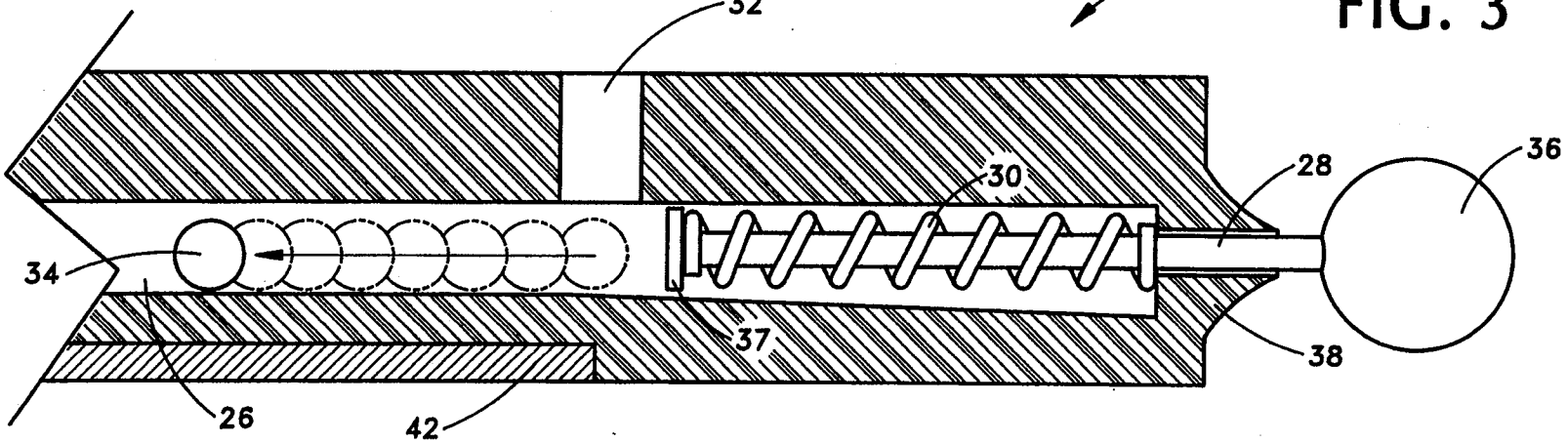
FIG. 3 is a cross sectional elevational view of the impelling device of FIG. 2, wherein the impelling device is shown in a normal or unflexed configuration following the ejection of a projectile therefrom.

FIGS. 2 and 3 show the details of construction of the impeller devices 18, each of which preferably includes an elongated bore 26 extending inward from a side of the housing 12, a plunger member 28 positioned in the bore 26 and extending outside the periphery of the housing member 12, a coil spring 30 for biasing the plunger member toward the playing chamber 14, and an entry aperture 32 for loading a projectile 34 into the bore 26. As seen in FIGS. 2 and 3, the bore 26 preferably slopes downward as it extends outward from the playing chamber 14. The exterior distal end of the plunger member 28 is furnished with a preferably spherical handle 36 for grasping by a player, and the interior distal end of the plunger member 28 has a circular flange 37 for striking the projectile 34 and for retaining the coil spring 30. As seen in FIGS. 1–3, the exterior surface of the housing 12 surrounding the plunger member 28 is preferably shaped to form a raised conical portion 38. Additionally, as is seen in FIG. 1, the interior opening of the bore 26 preferably flares outward in the horizontal plane along a curved surface 40, and the entry apertures 32 extend through the upper surface of the housing 12.

Additionally seen in FIGS. 2 and 3 is a substantially weighted plate member 42, which is preferably countersunk into the bottom surface of the housing 12 and which serves to help maintain the game apparatus 10 stable during play. Preferably, the weighted plate member 42 is a substantially square plate of a metal, such as steel.

Figure 4:
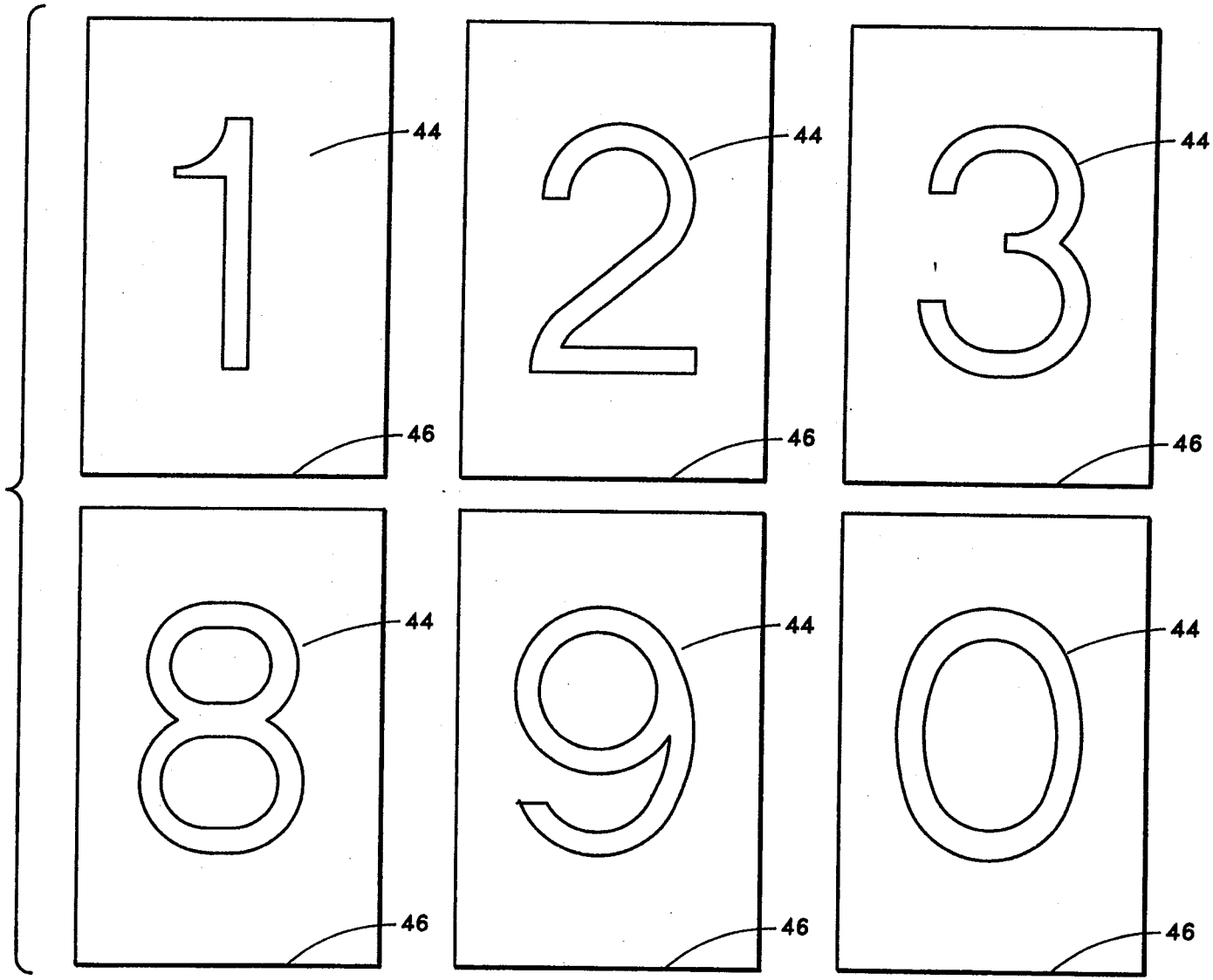
FIG. 4 is an illustration of a first embodiment of a set of targets used in the inventive game apparatus, showing sequential numbers displayed on the targets.
Figure 5:
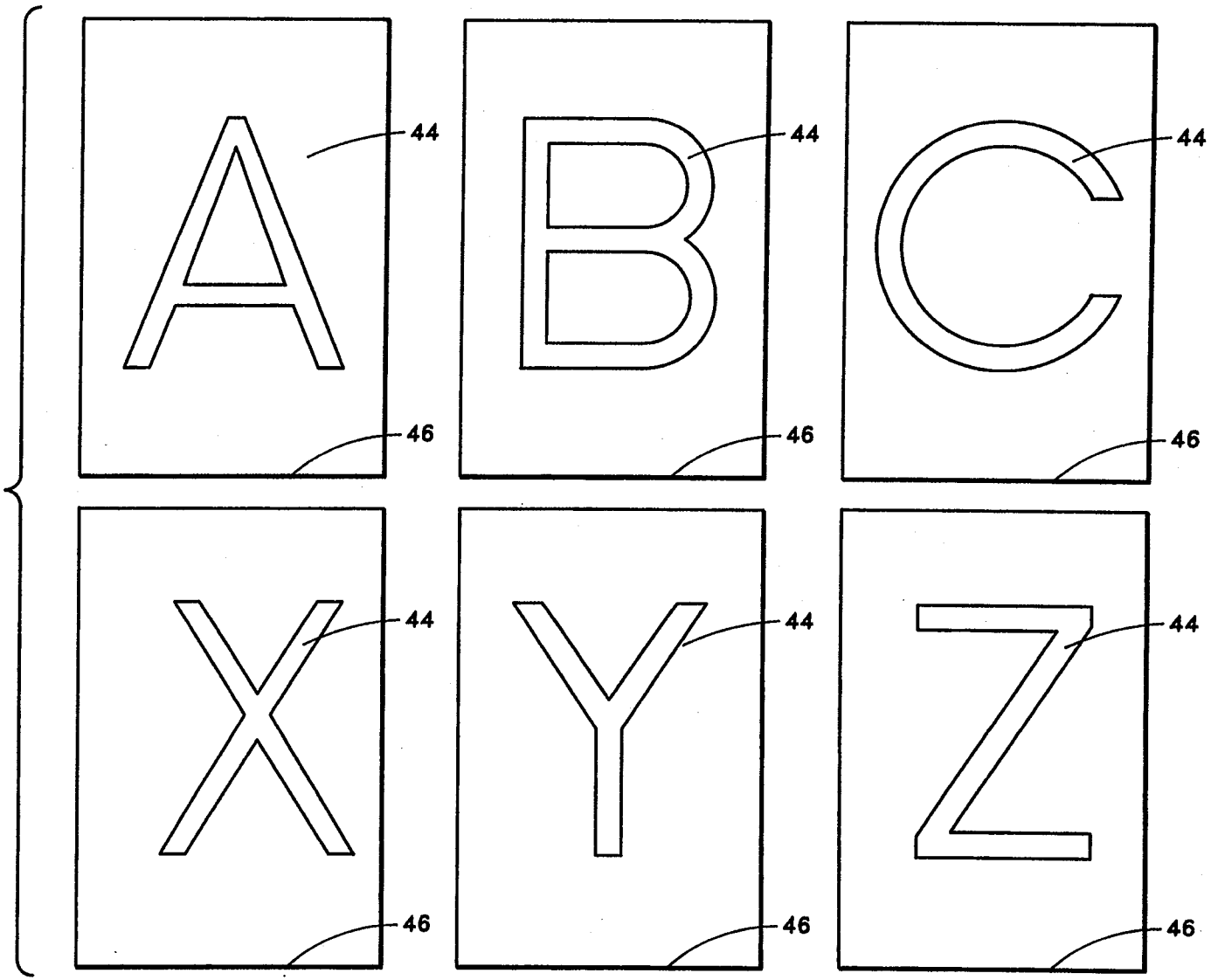
FIG. 5 is an illustration of a second embodiment of a set of targets used in the inventive game apparatus, showing sequential letters displayed on the targets.
Figure 6:
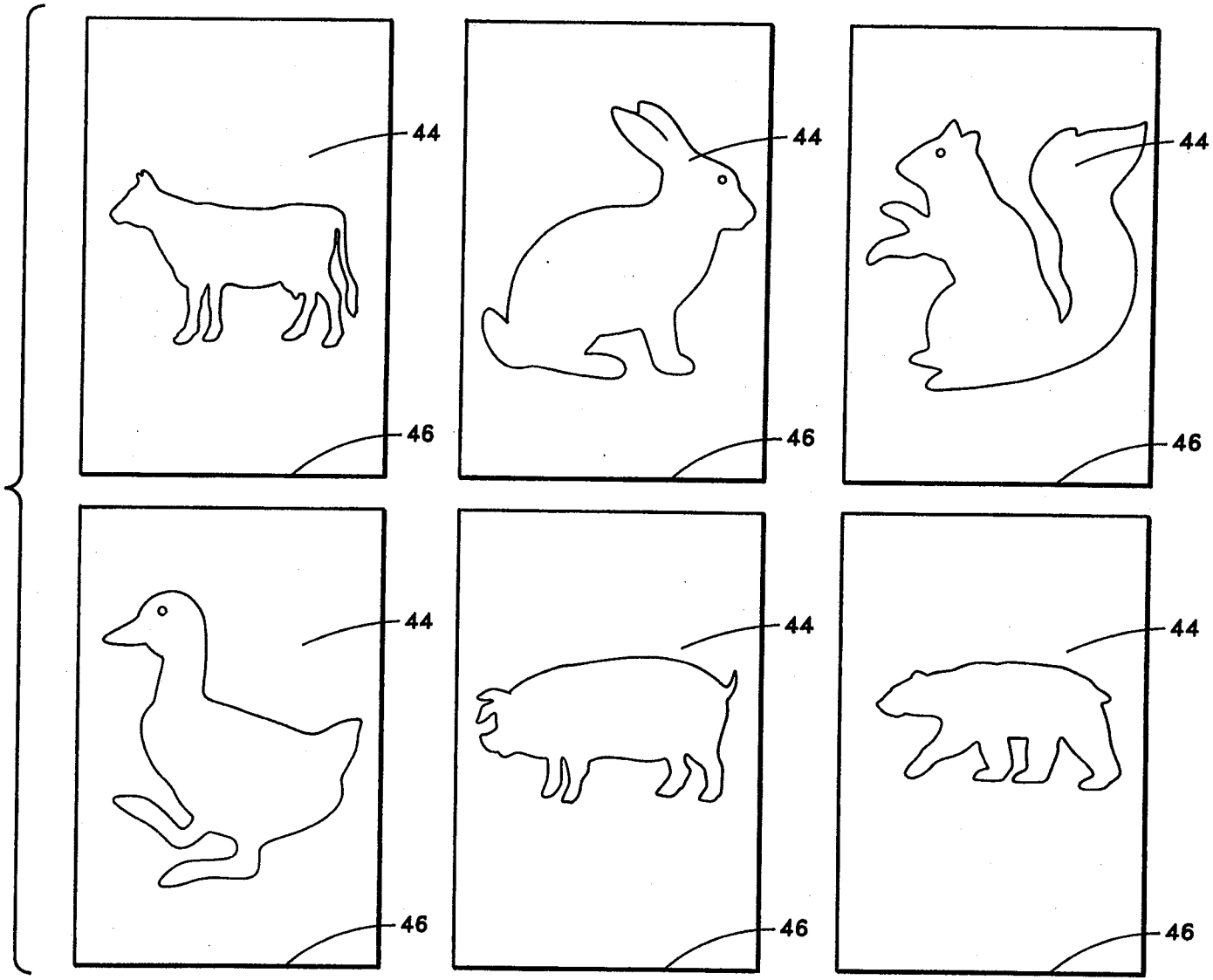
FIG. 6 is an illustration of a third embodiment of a set of targets used in the inventive game apparatus, showing representations of animals displayed on the targets.

Referring back to FIG. 1, the game apparatus additionally includes a number of targets 44 that are arranged by the players on a playing field that forms the bottom surface of the playing chamber 14, various embodiments of the targets 44 being illustrated in FIGS. 4–6. Each of the targets 44 is preferably a three dimensional object having a substantially planar base 46, and most preferably, each of the targets 44 is in the form of a rectilinear block member. Preferably, in each of the embodiments, the targets are provided with various alphanumeric indicia or pictorial information displayed thereon. Thus, in the embodiment illustrated in FIG. 4, each of the targets 44 has printed or otherwise displayed thereon one of a series of sequential numbers. In the embodiment illustrated in FIG. 5, each of the targets 44 has printed or otherwise displayed thereon one of a series of sequential letters. Finally, in the embodiment illustrated in FIG. 6, each of the targets 44 has printed or otherwise displayed thereon a pictorial representation of an animal, e.g., a cow, a rabbit, a squirrel, etc.

In use, the players, of which there may preferably be one to four, take turns in attempting to impel the projectiles 34 into the playing chamber 14 and knock down as many of the targets 44 as possible. The projectiles 34 are loaded into the bores of the impeller devices 18 via the entry apertures 32 provided in the top surface of the housing 12. The panel 20 may be removed to allow the targets 44 to be again set up, and with the panel 20 in place over the playing chamber 14, the projectiles 34 are prevented from bouncing out of the playing chamber 14 and causing injury.

While the game apparatus 10 may seem quite simple to some, therein lies its charm for entertaining and educating young children, who enjoy its simplicity.

Preferably, the entire housing 12 is integrally molded from a single piece of plastic or like material, with the bores 26, the raised conical portions 38, the ledge structure 22, the entry apertures 32, the depressions 24, etc. formed therein.

While the invention has been herein described by way of a particular preferred embodiment, various substitutions of equivalents may be effected without departing from the spirit and scope of the invention as set forth in the following claims.

What is claimed is:

1. A game apparatus comprising:

a housing enclosing a playing chamber therewithin;

said housing being substantially parallelepiped-shaped;

said parallelepiped-shaped housing having a profile that is substantially square in plan view;

said playing chamber comprising a depressed cavity disposed within the periphery of said parallelepiped-shaped housing;

at least one pair of substantially opposing impeller devices sharing a common longitudinal axis for impelling a projectile into said playing chamber, each of said pair of impeller devices comprising:

a longitudinal bore provided in said housing;

a plunger member positioned within said bore and extending outside of said housing;

a spring means, on the plunger member, for biasing said plunger member toward the playing chamber;

an entry aperture into said bore for the loading of said projectile thereinto;

said housing comprising a panel forming at least a portion of the periphery of said playing chamber;

said panel being removable from said housing to thereby permit access to the interior of said playing chamber;

said removable panel being substantially transparent;

said removable panel being disposed on an upper surface of said parallelepiped-shaped housing;

said removable panel being disposed over and covering substantially all of said depressed cavity;

a plurality of removable and replaceable targets placed within said playing chamber; and each of said plurality of targets comprising a rectilinear block member having a substantially planar base.

2. A game apparatus according to claim 1, wherein said parallelepiped-shaped housing is provided with a depressed ledge structure surrounding said depressed cavity, said removable panel resting on said depressed ledge structure.

3. A game apparatus according to claim 2, wherein said parallelepiped-shaped housing is provided with a plurality of depressions surrounding said removable panel for providing a place for an individual to lift said removable panel from said parallelepiped-shaped housing.

4. A game apparatus according to claim 3, wherein said game apparatus additionally comprises a substantially planar weight disposed in a bottom surface of said housing.

5. A game apparatus according to claim 4, wherein said entry aperture is disposed in an upper surface of said housing.

* * * * *